US006892915B2

(12) United States Patent
Mares

(10) Patent No.: US 6,892,915 B2
(45) Date of Patent: May 17, 2005

(54) PACK FRAME ASSEMBLY AND HYDRATION SYSTEMS INCORPORATING THE SAME

(75) Inventor: Vincent C. Mares, Novato, CA (US)

(73) Assignee: CamelBak Products, LLC, Petaluma, CA (US)

( * ) Notice: Subject to any disclaimer, the term of this patent is extended or adjusted under 35 U.S.C. 154(b) by 80 days.

(21) Appl. No.: 10/417,352

(22) Filed: Apr. 15, 2003

(65) Prior Publication Data

US 2004/0007605 A1 Jan. 15, 2004

Related U.S. Application Data

(60) Provisional application No. 60/372,912, filed on Apr. 15, 2002.

(51) Int. Cl.[7] ..... A45F 3/04

(52) U.S. Cl. ..... 224/630; 224/148.5; 224/631

(58) Field of Search ..... 224/628, 630, 224/631, 148.4, 148.5

(56) References Cited

U.S. PATENT DOCUMENTS

| | | | | |
|---|---|---|---|---|
| 5,060,833 | A | 10/1991 | Edison et al. | |
| 5,085,349 | A | 2/1992 | Fawcett | |
| 5,131,576 | A | 7/1992 | Turnipseed | |
| 5,341,974 | A | 8/1994 | Robinson et al. | |
| 5,366,126 | A | 11/1994 | Dausien | |
| 5,573,166 | A | 11/1996 | Leja | |
| 5,632,429 | A | 5/1997 | Cantwell | |
| 5,727,714 | A | 3/1998 | Fawcett | |
| D398,776 | S | 9/1998 | Fawcett | |
| 5,803,333 | A | 9/1998 | Fawcett | |
| 5,890,640 | A | 4/1999 | Thompson | |
| D411,915 | S | 7/1999 | George | |
| 5,954,253 | A * | 9/1999 | Swetish | 224/631 |
| 5,971,244 | A | 10/1999 | Jaeger | |
| 5,975,387 | A * | 11/1999 | Gleason et al. | 224/148.2 |
| 6,032,831 | A | 3/2000 | Gardner et al. | |
| 6,070,767 | A | 6/2000 | Gardner et al. | |
| 6,276,584 | B1 | 8/2001 | McLachlan | |
| 6,325,262 | B1 | 12/2001 | Thompson | |
| 6,332,566 | B1 | 12/2001 | Rota | |
| 6,364,168 | B1 | 4/2002 | Gardner et al. | |
| 6,422,439 | B1 * | 7/2002 | Kelliher et al. | 224/148.2 |
| 6,497,348 | B2 | 12/2002 | Forsman et al. | |
| 6,607,107 | B2 * | 8/2003 | Dexheimer | 224/604 |

FOREIGN PATENT DOCUMENTS

| | | |
|---|---|---|
| AT | 66005 | 8/1914 |
| AT | 133687 | 6/1933 |
| AT | 173120 | 5/1952 |
| CH | 79582 | 3/1918 |
| CH | 191988 | 7/1937 |
| DE | 562651 | 10/1932 |
| EP | 0 351 333 | 7/1989 |
| FR | 517962 | 12/1920 |
| WO | WO 94/13172 | 6/1994 |

* cited by examiner

*Primary Examiner*—Stephen K. Cronin
(74) *Attorney, Agent, or Firm*—Kolisch Hartwell, P.C.

(57) ABSTRACT

Packs that have a body-conforming frame assembly. In some embodiments, the frame assembly is adapted to conform in multiple dimensions to the shape of a user's back or other body portion. In some embodiments, the frame assembly's shape is at least substantially defined by the shape of the flexible pack to which the frame assembly is secured. In some embodiments, the pack includes a retainer assembly that secures the frame assembly to the pack, with the retainer assembly optionally defining a compartment that is smaller in at least one dimension than the frame assembly. The frame assembly may be an internal or an external frame assembly and may include ventilation structure. In some embodiments, the pack includes a hydration system, with the pack including a compartment that receives a fluid reservoir, from which a drinking tube extends external the pack to a mouthpiece.

20 Claims, 13 Drawing Sheets

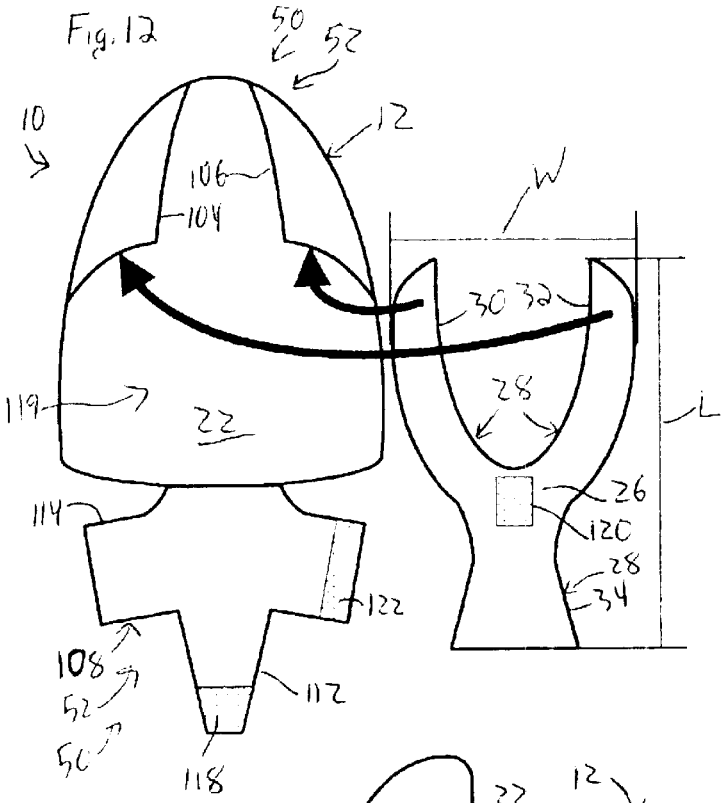
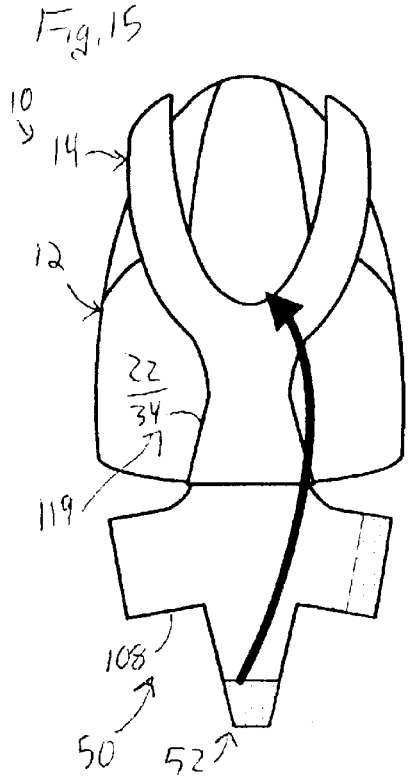
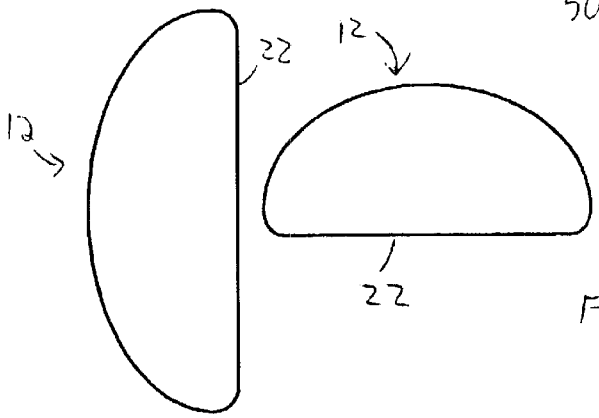
Fig. 14
Fig. 13

Fig. 16
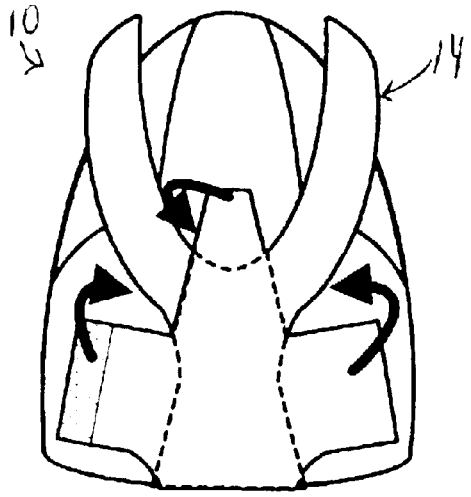
Fig. 17
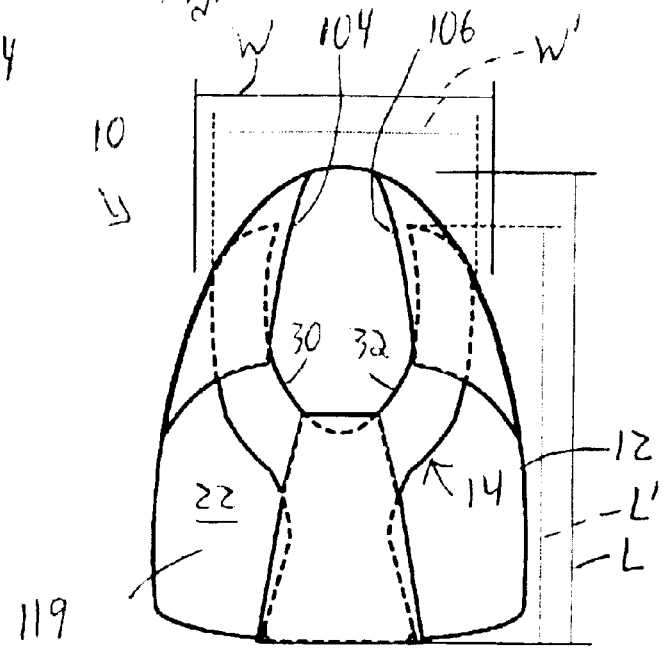
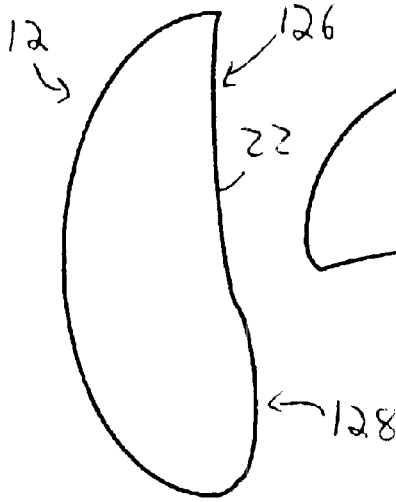
Fig. 18
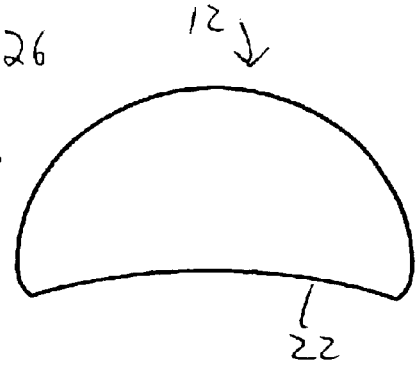
Fig. 19

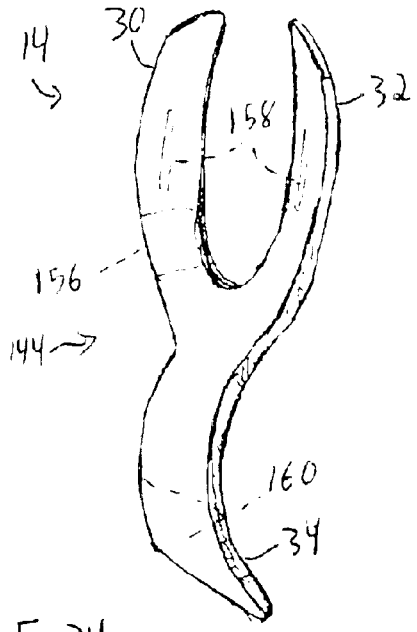
Fig. 24
Fig. 25
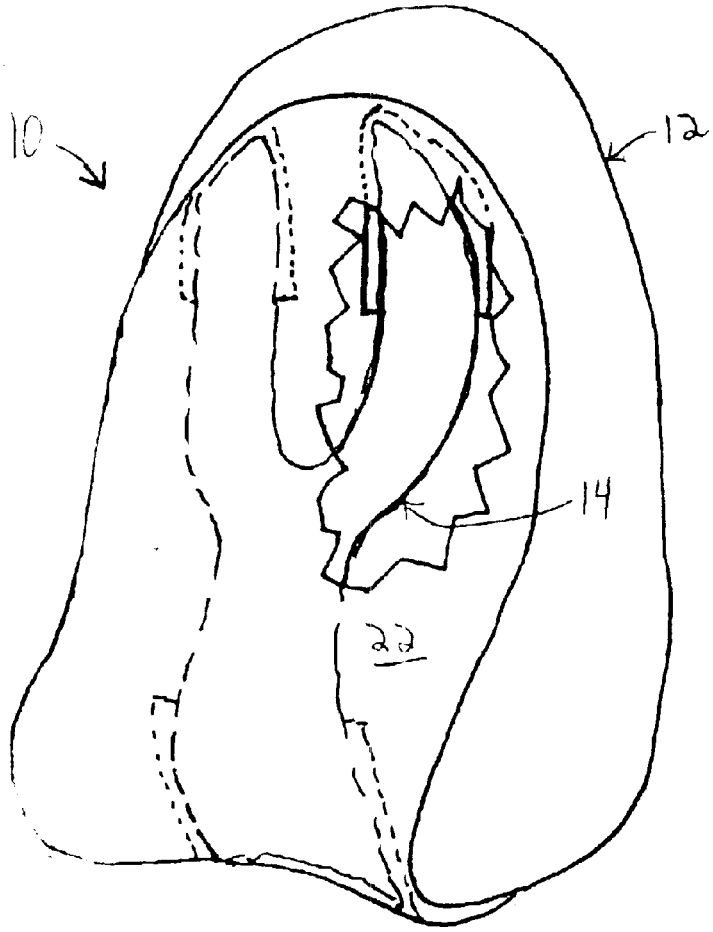

PACK FRAME ASSEMBLY AND HYDRATION SYSTEMS INCORPORATING THE SAME

CROSS-REFERENCE TO RELATED APPLICATION

This application claims priority to U.S. Provisional Patent Application Ser. No. 60/372,912, which is entitled "Pack Frame assembly and Hydration Systems Incorporating the Same," was filed on Apr. 15, 2002, and the complete disclosure of which is hereby incorporated by reference for all purposes.

FIELD OF THE DISCLOSURE

The present disclosure relates generally to backpacks and back-mounted hydration systems, and more particularly, to contoured frame assemblies for such packs and systems.

BACKGROUND OF THE DISCLOSURE

Packs such as backpacks, hip-packs, and messenger-packs are often used to carry loads of various compositions and sizes. Much research has been focused towards designing and manufacturing packs to carry such loads more comfortably. One area of research has concentrated on support systems, which are sometimes referred to as support frames, or simply frames. In general, packs typically are either framed or unframed, meaning they either include a structured support system or do not. Unframed packs are typically constructed from one or more fabrics or similar materials that are sewn together or otherwise formed in the shape of one or more compartments. Because an unframed pack lacks a structural frame, the shape of the pack is largely amorphous and thereby defined by the shape of the pack's compartment(s), as affected by the load (objects carried within the compartment(s)) and/or the user's body upon which the pack is supported.

Framed packs are typically described as having either an internal or external frame. External frames conventionally are formed from metal or other suitable structural supports that are connected to the outside of the pack, typically as an interface between the pack's harness and the pack's storage compartment. Internal frames typically include one or more rigid plastic or metal support members that are housed within a compartment of the pack. With a conventional internal frame, the frame has a rigid construction that defines the shape of the flexible pack, which extends over the frame. An example of a simple internal frame is a rectangular sheet of plastic that is secured within a pack to provide stiffness and support to the pack's compartment. Some versions of such packs utilize a flexible plastic material, although the generally rectangular dimensions of the sheet of plastic typically only provide one degree of conformity, such as about the long axis of a user's back.

SUMMARY OF THE DISCLOSURE

The present disclosure is directed to packs that have a body-conforming frame assembly. In some embodiments, the frame assembly is adapted to conform in multiple dimensions to the shape of a user's back or other body portion. In some embodiments, the frame assembly's shape is at least substantially defined by the shape of the flexible pack to which the frame assembly is secured. In some embodiments, the pack includes a retainer assembly that secures the frame assembly to the pack, with the retainer assembly optionally defining a compartment that is smaller in at least one dimension than the frame assembly. The frame assembly may be an internal or an external frame assembly and may include ventilation structure. In some embodiments, the pack includes a hydration system, with the pack including a compartment that receives a fluid reservoir, from which a drinking tube extends external the pack to a mouthpiece.

BRIEF DESCRIPTION OF THE DRAWINGS

FIG. 12 is an exploded side elevation view of a pack and frame assembly according to the present disclosure.

FIG. 13 is a schematic side cross-sectional view of the pack of FIG. 12.

FIG. 14 is a schematic top cross-sectional view of the pack of FIG. 12.

FIG. 15 is a side elevation view of pack and frame assembly of FIG. 12 with the frame assembly positioned proximate the back-facing surface of the pack.

FIG. 16 is the side elevation view of FIG. 15, with a lower retention structure positioned to couple a portion of the frame assembly to the pack.

FIG. 17 is the side elevation view of FIG. 16, with the frame assembly coupled to the pack.

FIG. 18 is a schematic side cross-sectional view of the pack of FIG. 17.

FIG. 19 is a schematic top cross-sectional view of the pack of FIG. 17.

FIG. 24 is an isometric view of another frame assembly according to the present disclosure.

FIG. 25 is a fragmentary isometric view of a pack assembly with an internal frame assembly according to the present disclosure.

DETAILED DESCRIPTION AND BEST MODE OF THE DISCLOSURE

Figure 1:
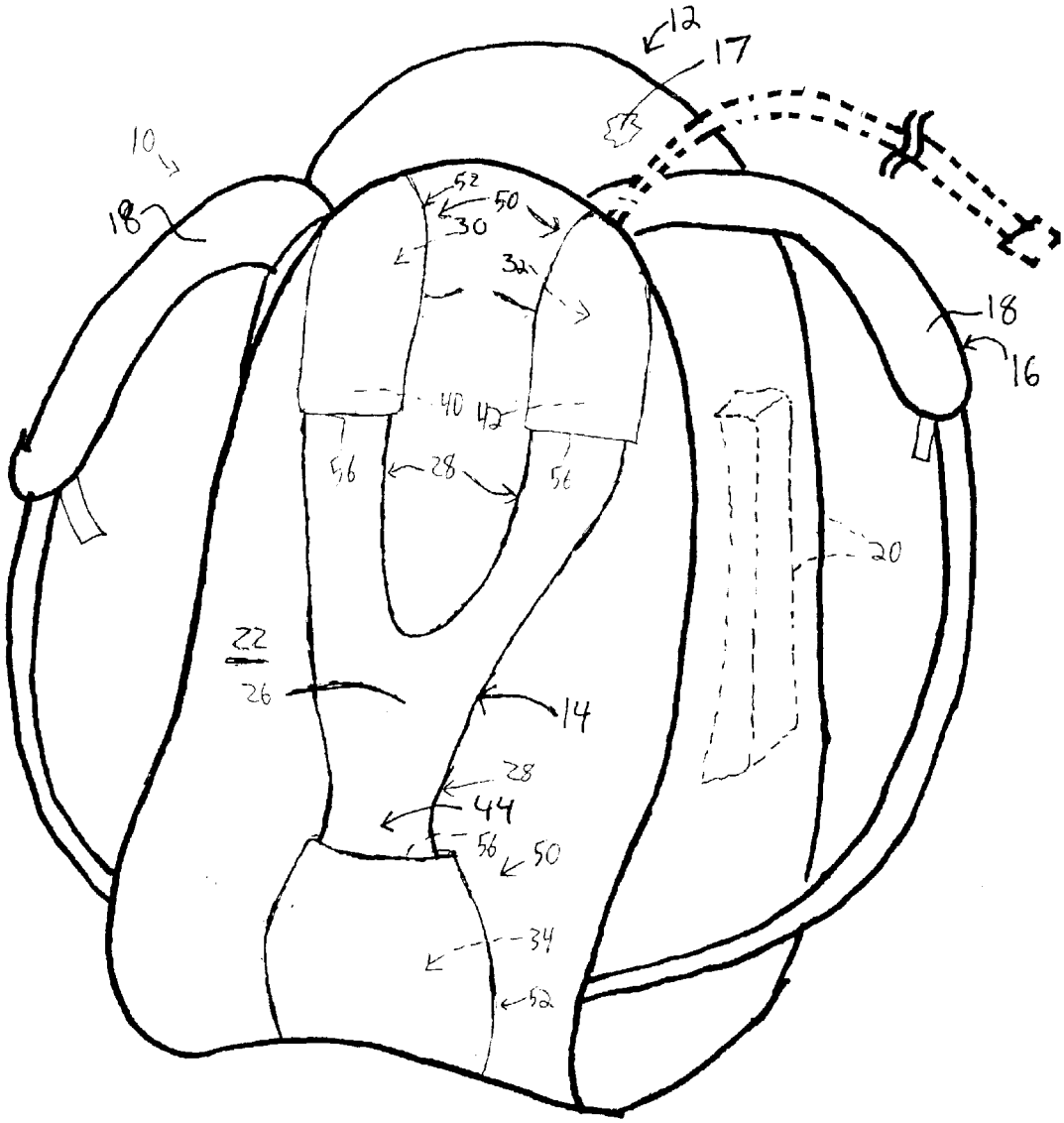
FIG. 1 is an isometric view of a backpack with a frame assembly according to the present disclosure.

FIG. 1 shows an exemplary pack assembly 10 with a frame assembly according to an embodiment of the present disclosure. Pack assembly 10 includes a pack 12, a frame assembly 14, and a harness, or body-securing strap assembly, 16. In the illustrative example shown in FIG. 1, pack 12 is shown as a backpack that includes a primary storage compartment 17 and a harness 16 that includes a pair of shoulder straps 18. However, pack assemblies of various types and sizes, which have different packs and/or harnesses, are within the scope of the present disclosure.

Pack assembly 10 is designed to be worn on a user's back, with the pack secured upon a user's body by harness 16. In the illustrative example, harness 16 includes a pair of shoulder straps 18, which define with the pack closed loops that are adapted to receive a user's arms therethrough, with the straps extending over a user's shoulders to support the pack upon a user's back. In this configuration, the pack includes a back-facing, or rear, surface 22, which is oriented toward the user's back. Other packs may include additional and/or alternative harnesses 16. For example, some packs additionally or alternatively include a hip harness, which is worn around a user's waist like a belt, thus supporting at least a portion of the weight of the pack on a user's hips. A hip harness may be included on a backpack, and especially a pack designed to carry heavy loads or designed to closely fit against a user's back. Some packs, which are commonly referred to as hip-packs or fanny packs, include only a hip harness and do not include a shoulder harness. Some packs, such as messenger packs, may be equipped with a single shoulder strap designed to support a pack on a user's body. Such a strap may cross a user's body, such as by resting on a right shoulder and traveling across the user's chest to go under the user's left arm, or vice versa. Some messenger packs may include a hip harness or other harness for holding the pack close to a user's body.

In the illustrative example shown in FIG. 1, pack assembly 10 has been illustrated with a primary storage compartment 17 that is adapted to receive and transport a load, namely, one or more objects. However, packs according to the present disclosure may include one or more auxiliary storage compartments, as schematically represented in dashed lines at 20. Such auxiliary storage compartments may have a variety of configurations, such as taking the form of subcompartments within primary compartment 17, and sub- or other compartments that are specifically sized to receive a particular object, such as a hydration system. Auxiliary storage compartments additionally or alternatively may take the form of internal or external pockets and/or pouches of different sizes, which may be used to carry a variety of items. The number and types of different compartments may be selected to correspond with an intended use of a particular pack. Some packs may include one or more selectively removable compartments, so that the pack may be modified by a user to provide increased versatility. The materials used to construct the various compartments may be selected according to the intended function of the compartment.

Frame assembly 14 is designed to provide structural support to the pack. As such, the frame at least substantially defines the shape of at least the rear surface 22 of the pack. Frame assembly 14 may be formed from any suitable structural material, meaning a material that has sufficient rigidity or stability to support the pack on a user's body and to at least substantially retain its shape when the pack is supported on the user's body. Accordingly, frame assembly 14 typically will define the shape of at least the rear surface of the pack, as opposed to fabric, padding, insulating materials and the like that are shaped by the user's back, and/or objects within the pack, and which are adapted to deform or otherwise give easily in response to internal or external forces that are applied thereto. Nonexclusive examples of suitable materials for frame assembly 14 include synthetic materials, such as high-density polyethylene or other plastic/polymeric materials, and/or metals, such as aluminum.

Figure 2:
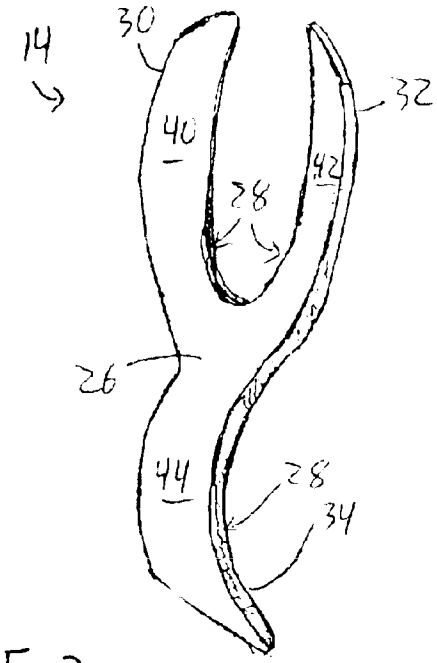
FIG. 2 is an isometric view of the frame assembly, or frame member, of FIG. 1.

As shown in FIGS. 1 and 2, frame assembly 14 includes a body, or body portion, 26 from which a plurality of projecting members 28 extend. As discussed in more detail herein, the frame assembly is preferably adapted to have a complex curvature, meaning to have at least one concave and at least one convex region relative to a user's back. For example, the frame assembly may include a longitudinal dimension with both concave and convex regions that are adapted to conform to the general lengthwise shape of a user's spine, and at least a lateral concave region that is adapted to conform to the general shape of a user's back between the user's shoulder blades.

In the illustrative example shown in FIGS. 1 and 2, the frame assembly includes three projecting members 26, which as depicted may be referred to as a pair of spaced apart upper arms 30 and 32 and a single lower leg 34. In such a configuration (two spaced-apart upper projecting members and a lower projecting member), the frame assembly may be described as having a wishbone frame, or Y-frame. Arms 30 and 32 collectively extend away from body portion 26 in a direction that is generally opposed to the direction lower leg 34 extends away from the body. However, arms 30 and 32 also individually angle or otherwise diverge and/or are spaced away from one another.

A human back has a complex shape, with both concave and convex regions. Accordingly, a frame assembly that only conforms in one general plane, such as to form a single concave or convex shape will only conform to a portion of a user's back. However, and as can be seen in the illustrative example shown in FIG. 2, a wishbone frame is well-suited for use in a backpack. As shown, lower leg 34 is shaped for alignment with the lower portion of a user's spine, such as on or proximate the user's lumbar region. Similarly, arms 30 and 32 are adapted to extend on opposed sides of a user's spine, such as on or proximate a user's shoulder blades.

Frame assembly 14 is preferably adapted to conform in several planes to the shape of a user's back. For example, in the illustrative example shown in FIG. 2, arms 30 and 32 include concave (relative to a user's back) regions 40 and 42 that are shaped to conform to the general shape of the upper portion of a user's back on each side of the user's spine, with lower leg 34 and/or body 24 including a convex region 44 that is shaped to conform to the general shape of the lumbar region of a user's back. In such a configuration, the frame assembly curves both vertically and laterally. Arrows are used in FIGS. 3 and 4 to illustrate regions having an inner, or concave, curvature. Furthermore, as described below, the frame assembly may be designed to maintain the pack away from a user's body in desired locations, for example to form air channels to facilitate ventilation.

Figure 4:
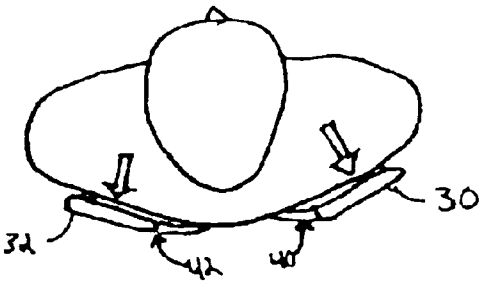
FIG. 4 is a top plan view showing the frame assembly of FIG. 2 conforming to a user's back.
Figure 3:
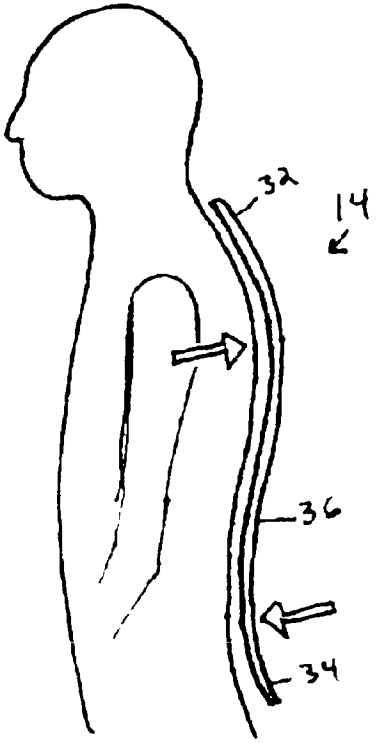
FIG. 3 is a side elevation view showing the frame assembly of FIG. 2 conforming to a user's back.

For the purpose of further illustrating the curvature of exemplary frame assembly 14, somewhat schematic depictions of frame assembly 14 positioned on a user's back are shown in FIGS. 3 and 4. As can be seen in FIG. 3, frame assembly 14 curves vertically along the long axis of a user's spine, bowing around a user's shoulder blade region, and flexing in against the user's lumbar region. FIG. 4 shows frame assembly 14 curving laterally as it bends around the user's back. As demonstrated by FIGS. 3 and 4, frame assembly 14 may curve in two dimensions (vertically and laterally). In other words, the frame may have a complex curvature, having one or more convex and concave region along two different axes. As described in more detail below, the frame may be constructed as a generally flat piece of sheet material that may be flexed into its curved shape by tension applied to the frame by a retention structure. In some embodiments, the frame may be constructed with a natural complex curvature, which may be further shaped by tension applied by a retention structure.

Pack assembly 10 further includes a retainer assembly 50 that is adapted to couple the frame assembly and the pack together. The retainer assembly includes at least one retention structure 52 that is adapted to couple portions of the frame assembly and the pack assembly together. It is within the scope of the present disclosure that retention structures 52 may be configured to permanently or fixedly secure a frame assembly to or within a pack or to releasably or removably secure the frame assembly to or within the pack. By "permanent" or "fixedly," it is meant that the components are joined together in such a way that they are not easily separated without destroying at least a portion of the pack assembly. By "releasable" or "removably," it is meant that the components are adapted to be repeatedly inserted into and removed from an assembled configuration without damaging or destroying either component or any other portion of the pack assembly. For example, components that are sewn or riveted together may be described as being fixedly or permanently secured together, while components that are snapped, coupled with a hook-and-loop mechanism, or retained in a tongue-and-pocket or similar relationship may be described as being releasably or removably secured together. In either case, such retention structures may be located internal a pack compartment, external a pack compartment, partially internal and partially external, and/or may include at least a portion of the pack. The retention structure may be connected to the pack directly, or may be indirectly connected to the pack via an intermediate structure, such as the harness.

An illustrative example of a suitable retainer assembly is shown in FIG. 1. As shown, retainer assembly includes a plurality of retention structures 52 in the form of sleeves or pockets 54 that define passages 56 into which the projecting members of the frame assembly are received. In the illustrative example, each projecting member is received into a separate pocket 54. It is within the scope of the present disclosure, however, that a pocket or other retention structure may be adapted to receive two or more projecting members. For example, arms 30 and 32 may be received within the same pocket, as schematically illustrated at 60 in FIG. 5. In such a configuration, the pocket may optionally be sewn, shaped and/or include one or more partitions, as indicated in dashed lines at 62, to define channels into which the corresponding projecting members of the frame assembly are inserted. Although not required to all embodiments, the pockets or other retention structure preferably defines a boundary region 64 (such as indicated in FIG. 5) that restricts the extent to which the frame assembly may translate vertically relative to the pack, with it being within the scope of the present disclosure that the retention structures are adapted to restrict vertical and horizontal movement of at least the ends of the projecting members relative thereto.

Figure 5:
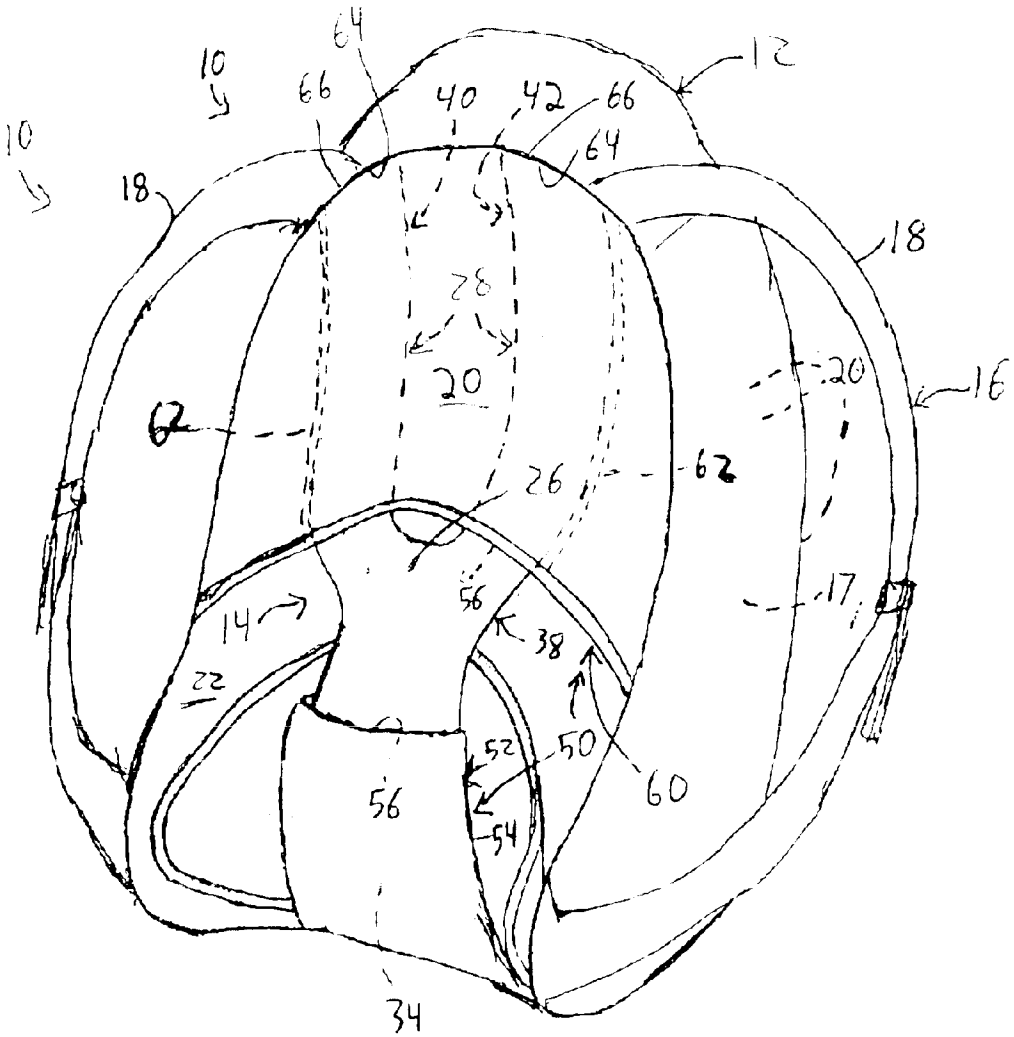
FIG. 5 is an isometric view of another backpack with a frame assembly according to the present disclosure.
Figure 6:
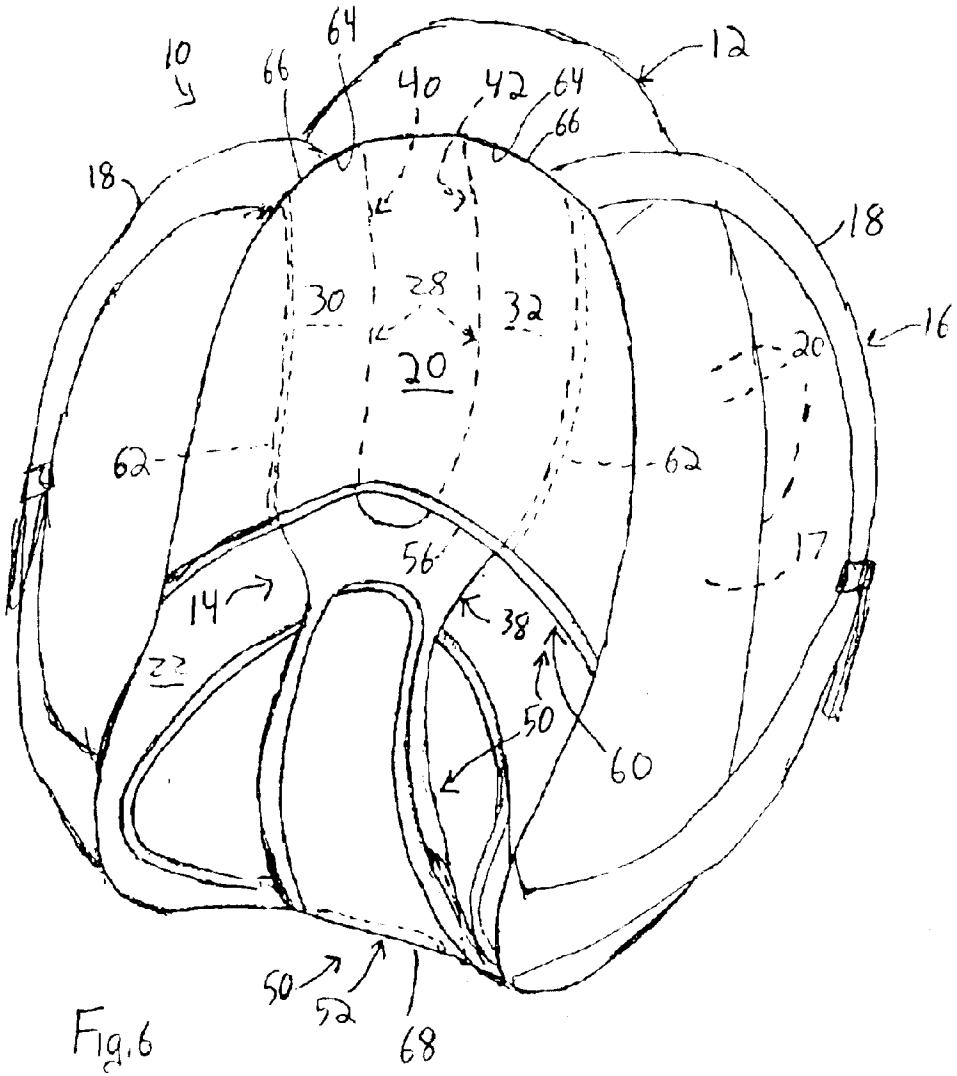
FIG. 6 is an isometric view of another backpack with a frame assembly according to the present disclosure.

In the illustrative examples of retention structures shown in FIGS. 1 and 5, the retention structures receive at least the end regions 66 of the projecting members, as graphically indicated in FIG. 5. It is within the scope of the present disclosure that other configurations of retention structures and/or retention mechanisms may be used to couple the frame assembly and the pack together. For example, in FIG. 6, an example of a retention structure 52 is schematically illustrated at 68 in the form of a weld, adhesive bond, stitching, seam, or similar mechanism that secures the end region of a projecting member to the pack.

Figure 8:
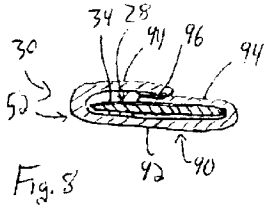
FIG. 8 is a fragmentary cross-sectional view of a retention structure of FIG. 7 coupled to a projecting member of the frame assembly of FIG. 7.
Figure 7:
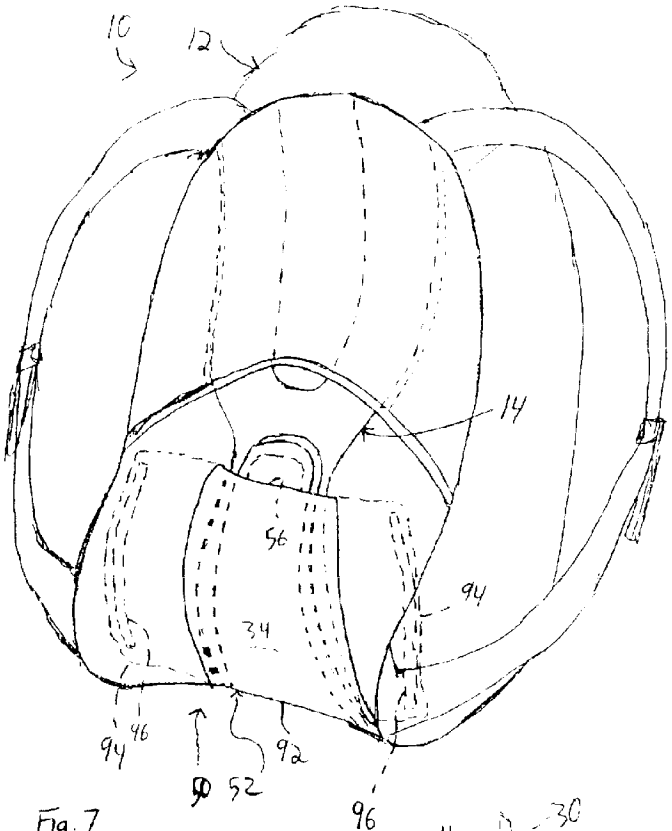
FIG. 7 is an isometric view of another backpack with a frame assembly according to the present disclosure.

In FIG. 7, another example of a suitable retention structure 62 is shown and indicated at 90. The retention structure includes a first region 92 that is fixedly secured to the pack 12, and also includes at least one free region 94 that extends from the first region and thereby is only indirectly secured to the pack. Free region 94 includes a releasable fastening mechanism 96, such as a hook-and-loop closure mechanism, zipper, snaps, clips, latches and the like, that enables the free region to be secured to another free region 94' or fixed region 92 to define a sleeve 98 with a corresponding internal channel 100 into which one of the projecting members of the frame assembly may be inserted, such as shown in FIG. 8. Releasable fastening mechanism 96 enables the retention structure to be secured around the corresponding region of the projecting member, such as arms 30 or 32 or leg 34, yet also opened to permit removal of the projecting member from the retention structure. It is within the scope of the present disclosure that any, or none, of the retention structures of a particular embodiment of pack assembly 10 may have this structure.

Figure 9:
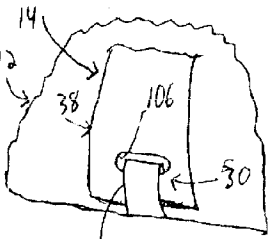
FIG. 9 is a fragmentary rear elevation view showing another illustrative retention structure for frame assemblies according to the present disclosure.

Another illustrative example of a retention structure 62 is shown in FIG. 9 and generally indicated at 102. Structure 102 is adapted to permanently or releasably couple an end or other region of a projecting member to pack 12 by straps 104 that extend through corresponding slots 106 in the frame assembly to position the frame assembly relative to the pack. Straps 104 may include a releasable fastening mechanism to provide for selective removal of the frame from the pack, or alternatively may be closed loops that fixedly secure the pack and the frame assembly together.

Figure 10:
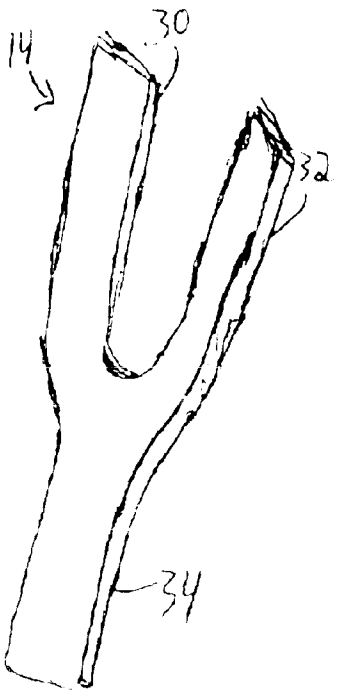
FIG. 10 is an isometric view of another illustrative frame assembly according to the present disclosure.
Figure 11:
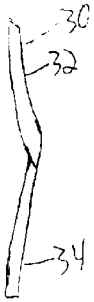
FIG. 11 is a side elevation view of another illustrative frame assembly according to the present disclosure.

Although it is within the scope of the present disclosure that frame assembly 14 is molded or otherwise shaped to have a desired curvature regardless of whether the frame assembly is coupled to a pack, it is also within the scope of the disclosure that the pack assembly at least partially, if not completely, defines the curvature or other shape of the pack assembly. For example, the exemplary frame assembly shown in FIGS. 1 and 2 may be constructed to have the depicted configuration regardless of whether the frame assembly is coupled to pack 12. However, it is also within the scope of the present disclosure that the frame assembly has a flat configuration, a generally flat configuration, or any other configuration that has less pronounced concave and/or convex regions relative to the shape of the frame assembly when it is coupled to the pack. For example, in FIGS. 10 and 11, illustrative flat and less-curved frame assemblies are shown. In such an embodiment, even though the pack is formed from a flexible material, this material still imparts a desired curvature to the frame assembly by defining a socket or other receptacle that is smaller in at least one dimension than the corresponding dimension of the frame assembly that is secured or otherwise mounted therein. For example if the pack defines a socket or frame region that is shorter in length and/or width than the corresponding dimension of the frame assembly, the frame assembly cannot lie flat within the socket and therefore will be biased or otherwise forced to have a curved configuration. The socket may also be described as a frame compartment or frame boundary.

FIGS. 12–19 provide a graphical example of a frame assembly 14 being coupled to a pack with retention structure 60 that defines at least a substantial portion of the curvature of the frame assembly. Pack 12 is somewhat schematically shown without a harness, auxiliary compartments, or other details to simplify illustration of how a frame assembly may interact with a retention structure to provide at least the back-facing surface of the pack with a complex curvature. As shown in FIG. 12, frame assembly 12 may be described as having a length L and a width W. Retainer assembly 50 includes a retention structure in the form of a pair of arm-receiving sleeves 104 and 106 that are shaped to receive arms 30 and 32 of frame assembly 14. Retainer assembly 60 also includes a retention structure in the form of an adjustable leg-receiving sleeve 108. FIGS. 13 and 14 respectively show schematic side and top views of pack 12 when frame assembly 12 is not coupled thereto by retainer assembly 50. It should be understood that without frame assembly 14, pack 12 would be unsupported, and would thereby deform to adopt the shape of its load, as affected by a user's body. However, for the purpose of illustrating the functionality of frame assembly 14, the back-facing surface 22 of pack 12 is illustrated as having a substantially planar disposition.

In FIG. 15, frame assembly 14 has been placed next to back-facing surface 22 of pack 12. As indicated by the bold arrow, leg-receiving sleeve 108 may be moved to position leg 34 of the frame assembly between back-facing surface 22 and leg receiving sleeve 108. As shown in FIG. 16, the leg-receiving sleeve includes flaps 112, 114, and 116, which may be wrapped around portions of the frame, as indicated by arrows. As can perhaps be best seen by referring back to FIG. 12, top flap 112 includes a hook fastener 118 that is complementarily configured to releasably fasten with a loop fastener 120 of the frame assembly. Similarly, side flaps 114 and 116 respectively include complementarily configured hook and loop fasteners 122 and 124, thus enabling the flaps to be wrapped around leg 34 and secured to one another. In this manner, the leg may be releasably coupled to the pack. The leg-receiving sleeve may include padding for cushioning the frame leg against a user's lumbar region. Similarly, it is within the scope of the present disclosure that the sleeve may be formed without at least one of the flaps, with the other flaps being selectively secured to each other and/or to the frame member or pack.

Frame assembly arms 30 and 32 may be inserted into corresponding arm receiving sleeves 104 and 106, as shown in FIG. 17. When installed into the retention structure in this manner, frame assembly 14 flexes to adopt a curved, or more significantly curved, configuration because the retention structure defines a frame-receiving socket 119 that is not as long or as wide as the unflexed frame. The flexed frame may be described as having a length L' and a width W'. The amount of difference between the length (L–L') and/or width (W–W') of the retention structure and the frame assembly may be set to impart a desired curvature to at least the back-facing surface 22 of the pack. In general, greater differences in width correspond to more severe lateral curvatures, while greater differences in length correspond to more severe vertical curvatures. Furthermore, the alignment of the retention structure may be set to encourage the frame assembly to flex in a desired orientation. When the frame assembly is flexed laterally and vertically, a complex curvature is established, in which areas of convex and concave curvature may exist in one or more directions. FIG. 18 schematically demonstrates how frame assembly 14 imparts a concave curvature 126 to the shoulder region of pack 12, and a convex curvature 128 to the lumbar region of the pack. Similarly, FIG. 19 schematically demonstrates how frame assembly 14 imparts a lateral concave curvature 130 to the pack. It is within the scope of the present disclosure that the position and/or orientation of the retention structure may be changed to adjust the imparted curvature. Furthermore, a larger or smaller frame assembly may be used to adjust the curvature.

As discussed, frame assembly 14 is configured to at least generally conform to the shape of a user's back. However, because the shape of a user's back may change as the user moves, it is within the scope of the present disclosure that the frame assembly may be configured to dynamically adjust to the user, such as by flexing with the user during movement. For example, at least one, and preferably, most or all of the projecting members may be biased to extend generally toward a user's back and/or to bias or urge other portions of the frame assembly away from the user's back. As a more particular example, lower leg 34 may extend or otherwise be biased or flexed toward the user's back to at least generally conform to the user's lumbar region. The frame assembly branches from the body portion 26, angling towards a user's shoulder blade region. Because each arm of the frame extends on or proximate a different one of a user's shoulder blades, and because the user's shoulder blades may move independently of one another, the frame assembly may be adapted to dynamically move with the user's shoulder blades and thereby remain closely engaged with the shoulder blades. This tends to improve the dynamic fit of a pack for a user that is climbing, hiking, skiing, paddling, or jogging, or performing a similar activity in which a user's arms move independently of one another. The location of the frame assembly's body portion, namely, such as where the projecting members branch away from one another, may be positioned to improve the dynamic fit of the pack. In particular, positioning the body portion below a user's shoulder blade region so that the shoulder blades are not laterally connected by a continuous expanse of frame material has been found to improve dynamic fit. Although the wishbone shape facilitates a dynamic fit, it is able to provide comparable support to more conventional frame assemblies.

Retainer assemblies according to some embodiments of the present disclosure may include one or more adjustable retention structures. Adjustable retention structures allow the position and/or orientation of one or more projecting members of the frame assembly, and/or the degree of curvature of the frame assembly to be selectively adjusted by a user. This may be useful, for example, in adjusting the curvature of a frame assembly to more closely correspond to a particular user. Adjustable retention structures may be designed in either permanent or releasable configurations to secure either internal or external frame assemblies. In some embodiments, an adjustable retention structure may cooperate with a strap assembly for selectively tensioning the retention structure to position the retention structure in a desired selectable location.

Figure 20:
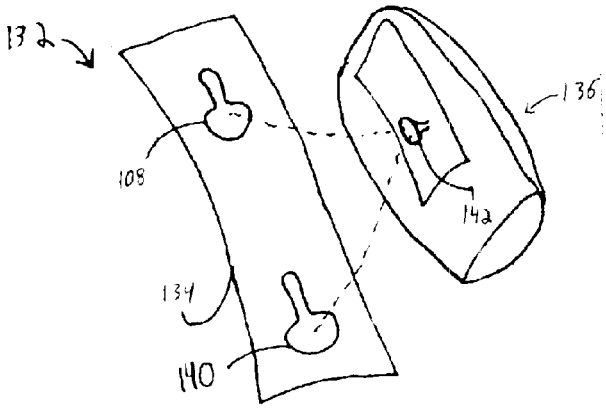
FIG. 20 is a fragmentary isometric view of an adjustable retention structure for coupling a frame assembly and a pack together.

FIG. 20 shows an illustrative example of an adjustable retention structure, which is generally indicated at 132. As shown, structure 132 includes a fixed portion 134 and an adjustable sleeve portion 136. The fixed portion includes a pair of slots 138 and 140 complementarily configured to receive a tab 142 of the sleeve portion. Tab 142 may optionally be secured in either slot 138 or 140, thus positioning the sleeve portion in one of two different locations on a pack. Although shown with only two slots, additional slots may be used to provide increased versatility. Furthermore, other adjustable retention structures may be used, such as those employing hook and loop connections. By positioning the frame assembly at different locations, the effective length, width, and/or orientation of a retention structure may be selectively altered, which accordingly alters the flex, or curvature, of an installed frame assembly. Therefore, an adjustable retention structure may be used to adjust the complex curvature of the frame assembly.

Frame assemblies 14 according to the present disclosure may be formed from a single sheet or piece of material. It is also within the scope of the disclosure that the frame assembly is formed from two or more pieces of the same or different materials, which are secured together, typically in a fixed orientation. Although not required, a benefit of a single piece of material is that the frame assembly may be stamped, molded, die cut or otherwise formed in a single step.

Figure 21:
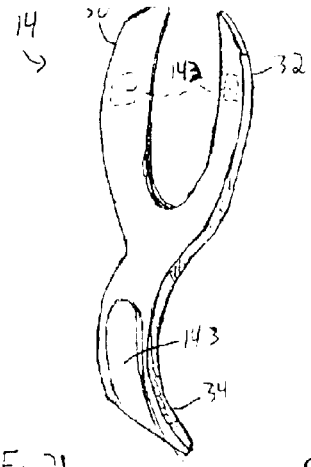
FIG. 21 is an isometric view of another frame assembly according to the present disclosure.

Frame assemblies 14 may include one or more pads, such as schematically illustrated in FIG. 21 at 143. Pads 143 extend from the frame assembly to cushion, or buffer, the contact or interactional forces between the frame assembly and a user's back. It is within the scope of the disclosure that the position, shape and number of pads may vary.

Figure 22:
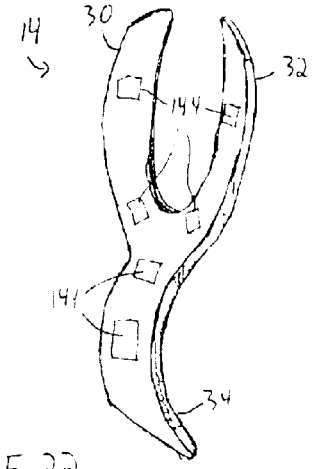
FIG. 22 is an isometric view of another frame assembly according to the present disclosure.

As schematically illustrated in FIG. 22, frame assemblies 14 according to the present disclosure also may (but are not required to) include shaping, or shape-defining, structure 144. Structure 144 is adapted to bias the frame assembly to a particular configuration. More particularly, shaping structure may be used to increase flexibility, decrease flexibility, and/or otherwise influence the disposition of frame assembly 14 responsive to compressive forces. For example, shaping structure 144 may be adapted to either bend or resist bending as the frame assembly is coupled to the pack with a retainer assembly that defines a receptacle that is smaller in at least one dimension than the frame assembly. In FIG. 22, the shaping structure 144 is schematically illustrated at various positions along frame assembly 14. In embodiments of frame assembly 14 that include shaping structure 144, it is within the scope of the present disclosure that the shaping structure may be positioned at a single region, or at a plurality of spaced-apart regions. In the context of pack assemblies with removable frame assemblies, the frame assemblies with and without shaping structure and/or with different shaping structure may be selectively interchanged to provide a selected curvature for a particular user or application.

Figure 23:
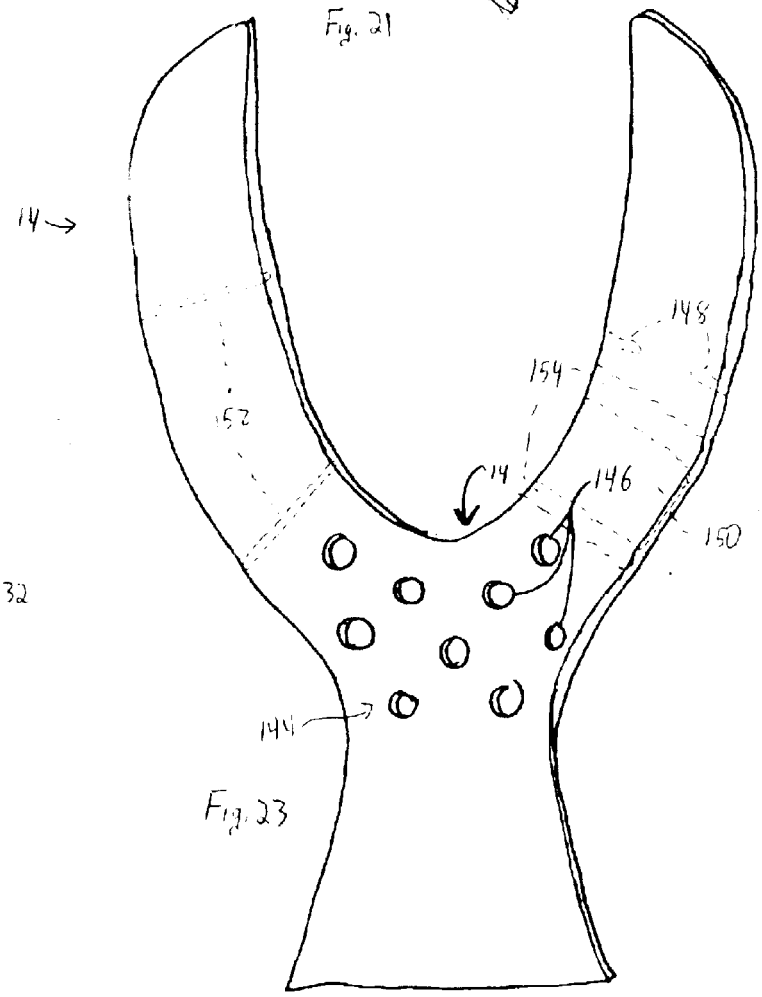
FIG. 23 is an isometric view of another frame assembly according to the present disclosure.

Illustrative examples of shaping structure that is adapted to increase the ability, or tendency, of a particular region of the frame assembly to bend include regions of lesser thickness or width than adjacent regions of the frame assembly, grooves or other relieved regions within a region of the frame assembly, and/or one or more holes or apertures in a region of the frame assembly. FIG. 22 shows an illustrative example of such a frame assembly, with shaping structure 144 taking the form of apertures, or holes, 146. As discussed, shaping structure may be incorporated into a frame assembly to influence the manner in which the frame assembly flexes. For example, holes 146 may be used to increase the flexibility of a frame region at a particular region, as the inclusion of holes results in a decrease in the amount of frame material available to resist flexing. As shown, holes 146 are located near an inflection portion of frame assembly 14, where the curvature of the frame assembly transitions from a concave curvature to a convex curvature when inserted into an appropriate retainer assembly. Such an increase in flexibility may be used to achieve a desired frame curvature. Additional examples of other shaping structure that is adapted to facilitate bending of the frame assembly is shown in dashed lines in FIG. 23 and includes notches 148, regions 150 of reduced thickness, grooves 152, and regions 154 of more flexible material.

Holes, notches, and similar shaping structure may provide other benefits as well. For example, holes 146 decrease the weight of the frame assembly and may provide air circulation paths through the frame assembly. Thus frame assembly 14 may be used, for example, in a pack assembly to achieve a different back-surface curvature, as well as different weight and air circulation characteristics than would otherwise be achieved without a frame assembly with shaping structure 144.

Shaping structure 144 may also be configured to resist bending or curvature of a region of the frame assembly. Examples of this type of shaping structure are schematically illustrated in FIG. 24 and include regions 156 of greater thickness, supporting ribs 158, and/or regions 160 of less flexible material.

The preceding examples have graphically demonstrated pack assemblies with external frame assemblies, meaning that at least a portion of the frame assemblies extend between the back-facing surface of the pack and the user's body when the pack assembly is used. It is also within the scope of the present disclosure that any of the frame assemblies and retainer assemblies described, illustrated and/or incorporated herein may be utilized with a pack assembly in which the frame assembly is located within the pack. In such a configuration, the frame assembly may be referred to as an internal frame assembly and the back-facing surface of the pack will extend generally between the frame assembly and the user's back when the pack assembly is used.

FIG. 25 provides an illustrative, somewhat schematic example of a pack assembly with an internal frame assembly 14. Internal frame assemblies may be located within the primary compartment of the pack, within an auxiliary compartment of the pack, within a primary or auxiliary compartment that is specially sized to receive the frame assembly, etc. As with external frame assemblies, internal frame assemblies may be either releasably or permanently secured to a pack. Similarly, any of the retainer assemblies described, illustrated and/or incorporated herein may be utilized. Similarly, internal frame assemblies may include any of the variations and optional structure described herein, such as shaping structure and/or pads.

As discussed previously, frame assembly 14 includes a plurality of projecting members. Although the previously described embodiments of frame assembly 14 all included projecting members in the form of a pair of upwardly extending arms and a downwardly extending leg, other configurations and numbers of projecting members may be used and are within the scope of the present disclosure. For example, frame assembly 14 may include at least a pair of upwardly and downwardly projecting members. Similarly, when two or more projecting members extend in the same general direction from the body of the frame assembly, the members may extend in convergent, divergent, or parallel configurations. It is further within the scope of the present disclosure that the projecting members may vary in distance from each other as they extend away from the body of the frame assembly.

Figure 26:
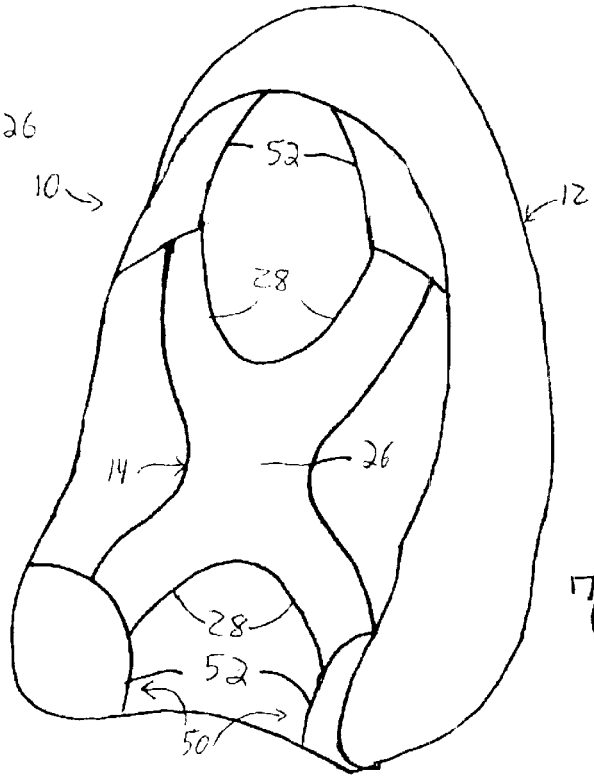
FIG. 26 is an isometric view of another pack with a frame assembly according to the present disclosure.

To provide an illustrative graphical depiction of a frame assembly with a different number of projecting members, a frame assembly is shown in FIG. 26 with four projecting members. As shown, the frame assembly has an X-shaped configuration and therefore may be referred to as being an X-frame. As discussed, however, other configurations are within the scope of the present disclosure, such as an H-shaped configuration, in which the upper and lower pairs of projecting members extend generally parallel from each other as they extend away from the body portion.

Figure 27:
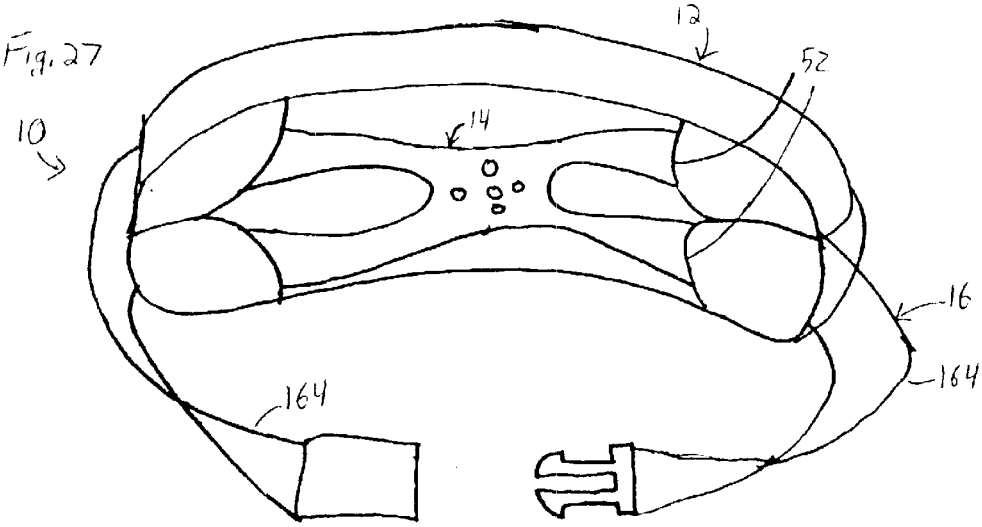
FIG. 27 is an isometric view of another pack assembly with a frame assembly according to the present disclosure.

As discussed, pack assembly 10 may be designed to be secured to a variety of positions on a user's body. Although the most common configuration is a backpack that is secured on a user's back, frame and retainer assemblies according to the present disclosure may be used with other types of packs. For example, FIG. 27 shows a pack assembly 10 that is adapted to be secured around a user's waist by a harness in the form of a belt, or waist strap, 164. As shown, pack 12 takes the form of a hip-pack with a frame assembly 14 in the form of an X-frame and which is coupled to the pack by a retainer assembly that defines pockets into which the projecting members of the frame assembly are received. In such an embodiment, the retainer assembly may be designed to define a frame-receiving socket that is smaller in at least one dimension that the corresponding frame so that the shape of the frame assembly is defined by the retention structure. As discussed, other variations of packs include hip-packs, messenger-packs, or other packs to add support, shape the pack to conform to a user's body, establish ventilation, etc.

Figure 28:
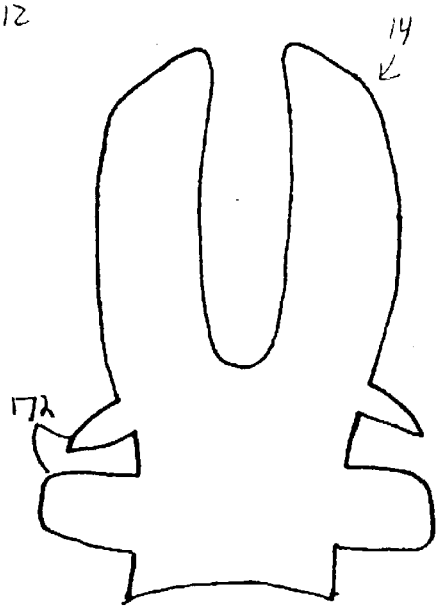
FIG. 28 is a side elevation view of another frame assembly according to the present disclosure.

FIG. 28 shows another exemplary frame variation, in which the frame assembly includes one or more lateral supports, or wings, 172 that extend generally transverse to the long axis of the frame assembly. Wings 172 are adapted to conform to the lateral shape of a user's back to help seat the pack securely on a user's back, and thereby prevent, or at least resist lateral shifting of the pack on a user's back. These and other frame variations are within the scope of this disclosure. The particular size, shape, and materials of a frame assembly may be chosen to customize pack performance for a desired intended purpose and/or to accommodate a particular individual.

Figure 29:
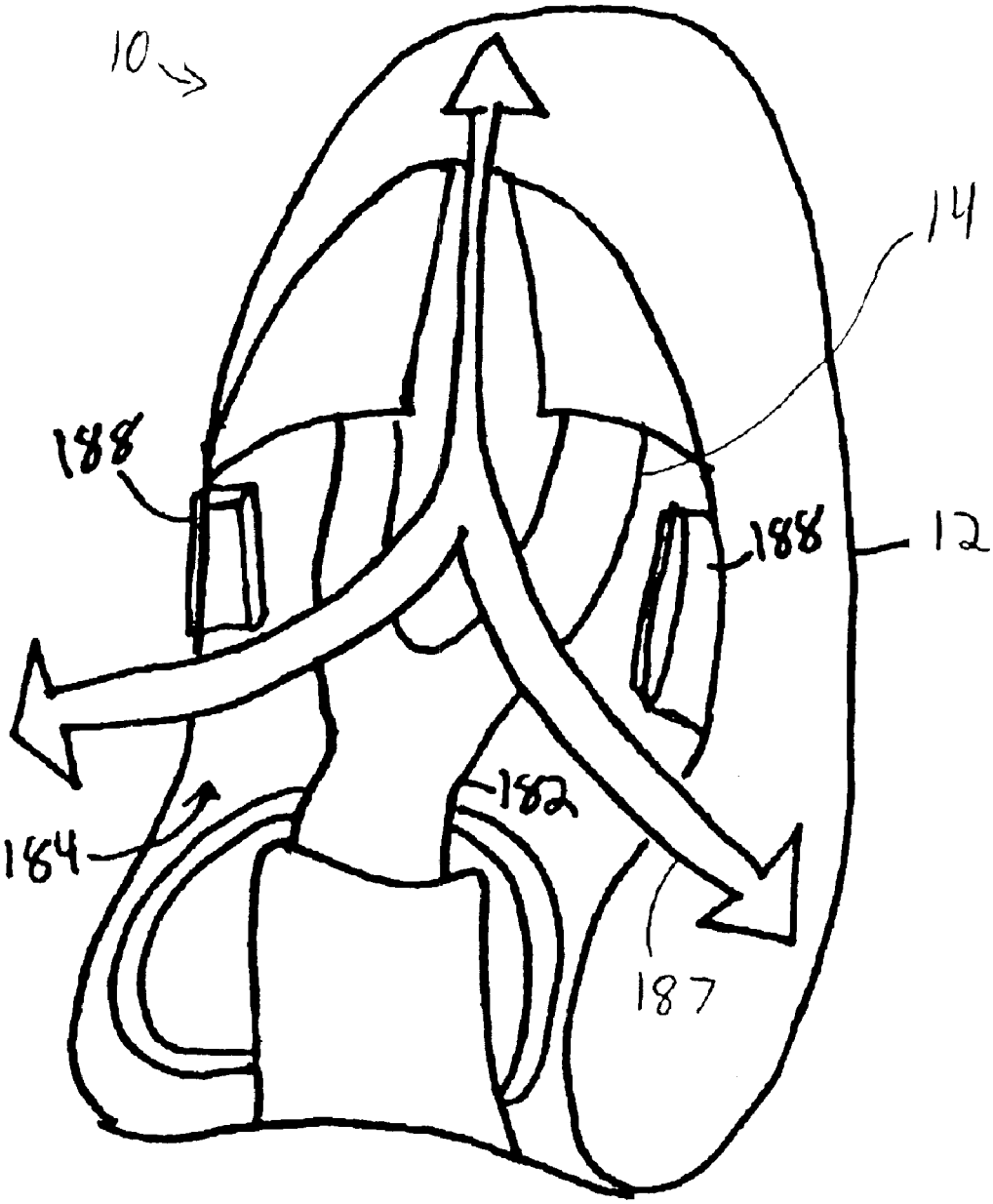
FIG. 29 is an isometric view of another pack and frame assembly according to the present disclosure.

Although not required, it is within the scope of the present disclosure that frame assemblies may be used to increase airflow between a user's body and the pack. For example, FIG. 29 shows a pack 12 that includes a wishbone frame assembly 14 that establishes a complex curvature along a back-facing surface 22 of the pack. As indicated with arrows in FIG. 29, the curvature of the frame assembly at least partially defines open conduits 187, which may facilitate air travel between a user's body and the back-facing surface of the pack. In other words, the frame assembly may hold or otherwise maintain portions of the pack away from a user's body so that air may flow between the user's body and the pack. Such air flow may help cool a user, making the pack more comfortable.

As also shown in FIG. 29, the pack and/or frame assembly may additionally or alternatively include spacers 188 that are positioned to space portions of frame assembly and/or back-facing surface 22 away from the user's body. Spacers 188 project from the pack assembly toward a user's back and may define additional conduits 187. Spacers may extend from any portion of the pack facing the user's body, such as the frame assembly, the retention structure, and/or the pack. Spacers 188 may be formed from a variety of materials, including rigid or structural materials. However, since the spacers usually engage the user's body (or the user's clothing or other garments on the user's body), the spacers preferably include or are at least partially formed from a padded, or resilient, material that cushions the forces applied by the pack system on a user's back.

Frame assembly may be adapted to support the pack at a variety of distances relative to a user's pack, such as with the back-facing surface of the pack positioned upon or very close to the user's back, or with at least a portion, if not all, of the back-facing surface spaced-away from the user's back. Securing a pack close to a user's body lessens the distance between the pack's center of gravity and a user's center of gravity. An increase in the distance that a pack extends from a user increases the amount the user's and pack's combined center of gravity shifts. Such a displacement in the center of gravity may be disadvantageous during some activities, such as climbing or skiing, where balance is important. Even when simply walking, a rearward shift in the center of gravity typically forces a user to compensate by leaning forward, which may put strain on the user's lower back, and/or otherwise strain the user. Frame assembly 14 closely conforms to a user's body and helps secure the pack close to a user's body, thus minimizing a shift in the user's center of gravity. As described herein, although holding the pack close to a user's body, air channels may be established to improve ventilation.

Figure 30:
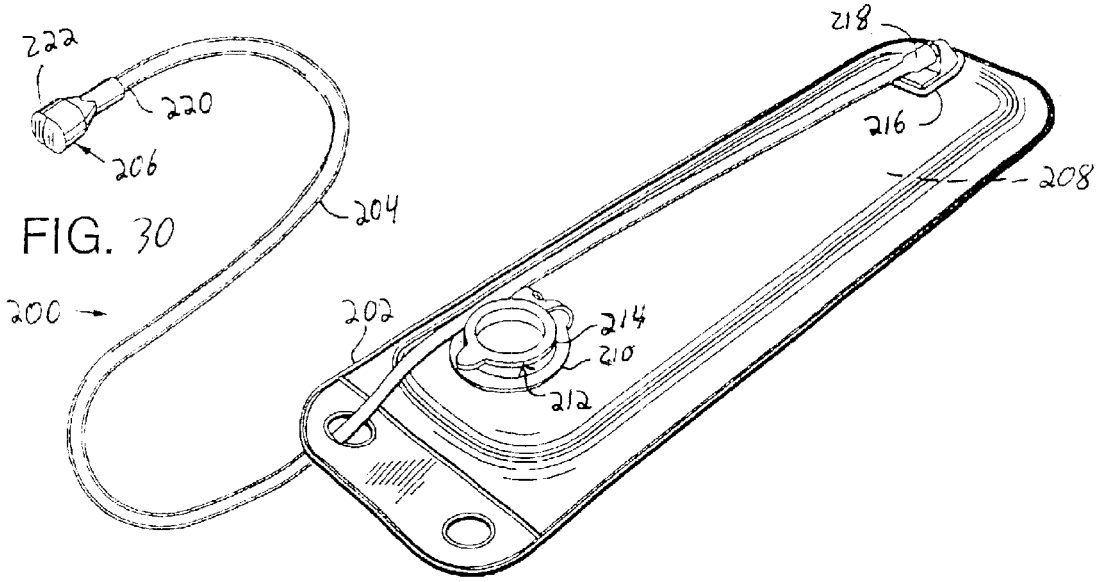
FIG. 30 is an isometric view of a hydration system.
Figure 31:
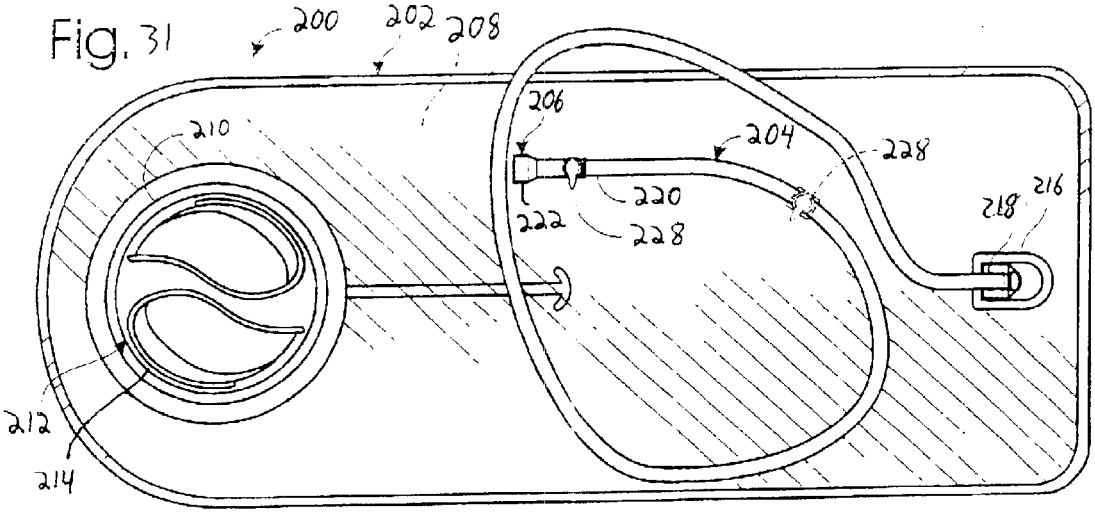
FIG. 31 is a top plan view of another hydration system.

As shown in dashed lines in FIG. 1, pack assemblies according to the present disclosure may include a hydration system 200. FIGS. 30 and 31 show an illustrative example of a hydration system in more detail. Hydration system 200 includes a fluid reservoir 202 that may be loaded into a compartment of a pack, and an elongate drinking tube, or hose, 204 that extends from the reservoir, out of the pack, and terminates at a mouthpiece 206 from which a user may drink from the reservoir. Reservoir 202 is designed to hold potable drink fluid, such as water or other water-based beverages, juice, sports drinks or the like. As shown, the reservoirs include an input port 210, through which drink fluid may be poured, and a closure 212 that selectively closes the input port. As shown, two examples of closures in the form of removable caps 214 are illustrated, although any suitable structure for selectively closing the input port may be used. As also shown, each reservoir includes an exit port 216 that fluidly connects reservoir 202 with an end region 218 of drink tube 204.

Figure 32:
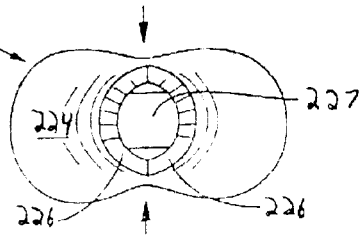
FIG. 32 is a front elevation view of the mouthpiece of the hydration system of FIGS. 30 and 31 in a dispensing position.

When a user sucks upon the other end 220 of the drink tube, the user can draw drink fluid from the reservoir. Although end 220 may itself form the mouthpiece for the hydration system, hydration systems typically include a mouthpiece 206 that is secured to end 220. In the illustrated embodiments, mouthpiece 206 takes the form of a bite-actuated mouthpiece 222, which is formed from a resilient material that is normally in a closed position, in which drink fluid cannot be dispensed through the mouthpiece. However, when a user bites upon, or otherwise exerts external forces to the mouthpiece transverse to the direction of fluid flow, such as shown in FIG. 32, the mouthpiece is urged to a dispensing position, in which drink fluid may be dispensed through the mouthpiece. Typically, bite-actuated mouthpieces are biased to automatically return to the closed position, such as after a user stops biting upon the mouthpiece. As shown in FIG. 32, the mouthpiece includes a dispensing face 224 with at least a pair of lips 226 that define a normally closed opening 227. However, when the user bites upon the body, or bite region, of the mouthpiece, such as indicated with arrows in FIG. 32, the mouthpiece is urged to its dispensing position, in which drink fluid may be drawn through opening 227. Also shown in FIG. 31 is an on/off valve 228, which may be included in a hydration system to enable a user to selectively prevent drink fluid from being able to be drawn through the reservoir regardless of the configuration of, or the forces being applied to, the mouthpiece.

Additional examples of suitable hydration systems and components thereof are disclosed in U.S. Pat. Nos. 6,070,767 and 6,032,831, as well as in U.S. patent application Ser. Nos. 09/902,935 and 09/902,792, the complete disclosures of which are hereby incorporated by reference for all purposes.

Figure 33:
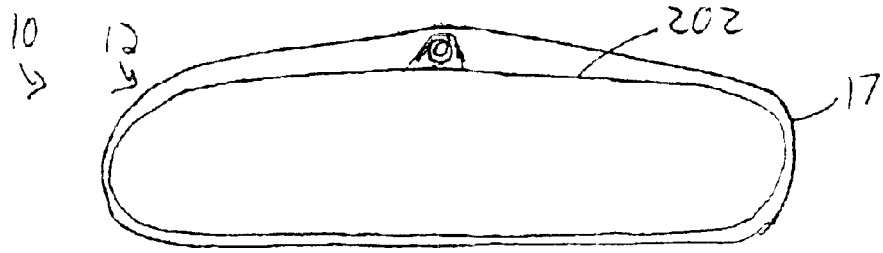
FIG. 33 is a schematic cross-sectional view of the reservoir of a hydration system and the compartment of a pack according to the present invention.
Figure 34:
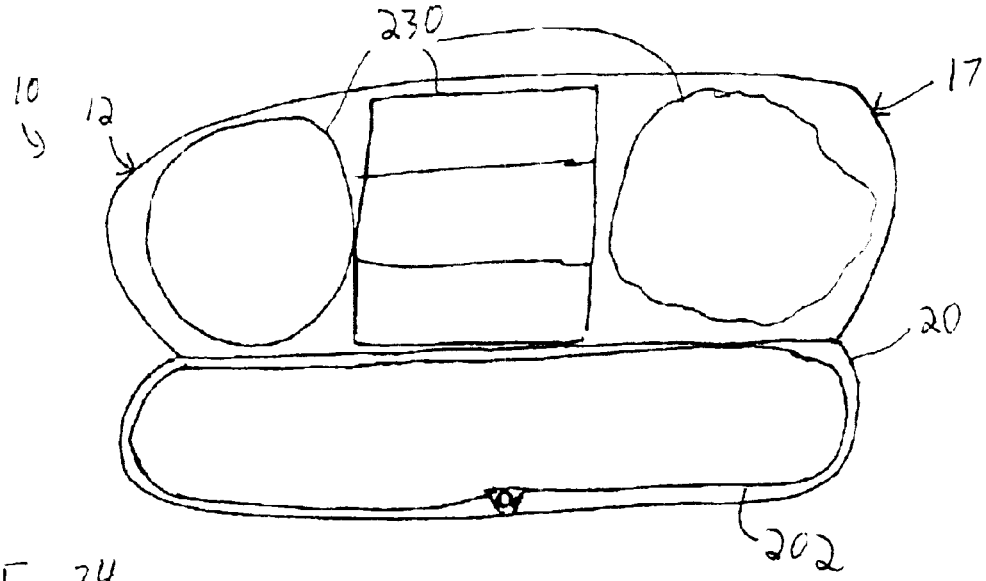
FIG. 34 is a schematic cross-sectional view of the reservoir of a hydration system and the compartments of a pack according to the present invention.
Figure 35:
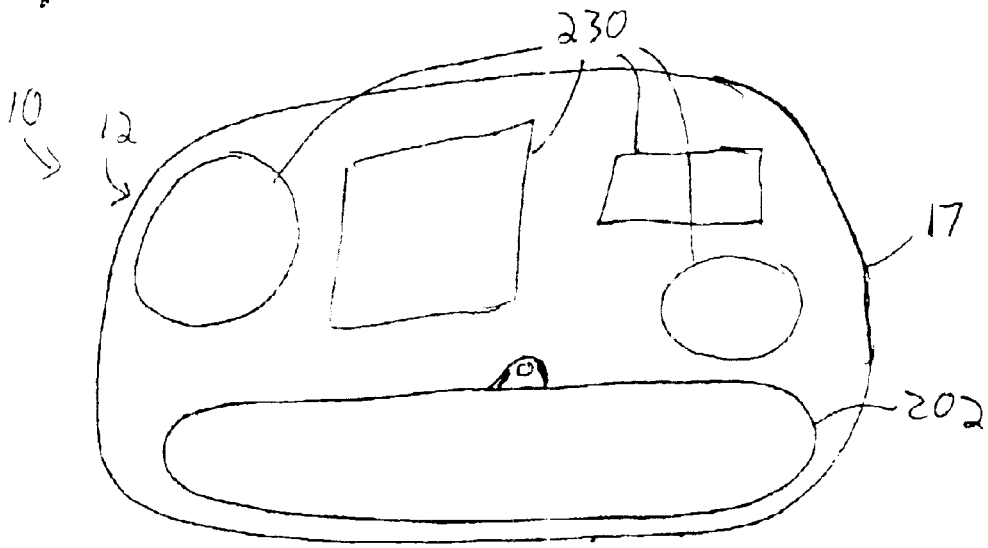
FIG. 35 is a schematic cross-sectional view of the reservoir of a hydration system and the compartments of a pack according to the present invention.

When pack assembly 10 includes a hydration system 200, the reservoir of the pack may include only a single compartment 17 that is sized specifically to receive the reservoir. An example of such a pack is shown in FIG. 33, in which the compartment is sized to conform to the shape of the reservoir when the reservoir is full of drink fluid, such as water, juice, sport drinks and the like. Because the compartment conforms generally to the shape of the reservoir, it reduces the tendency of the reservoir to slide or otherwise move freely within the reservoir when the pack is worn. Alternatively, the pack may also include one or more additional compartments (17 or 20), such as for carrying other items to be transported, such as books, camping gear, sporting articles, binoculars, food, etc. An example of such a pack is schematically illustrated in FIG. 34. As still another option, the pack may include a compartment 17" that is sized to receive reservoir 202 as well as other articles 230 to be transported, such as shown in FIG. 35. By this it is meant that the compartment is sufficiently large that even a fully filled reservoir only occupies a portion of the compartment, such as less than approximately 50% of the volume of the compartment, and not simply that one or more smaller articles may be crammed into a compartment that is sized to receive only the reservoir and connecting portion of the drinking tube.

The frame assemblies illustrated and described herein are described and/or illustrated in the context of particular exemplary packs to demonstrate the utility of the frame assemblies. However, frame assemblies according to the present disclosure may be applied to virtually any pack, including hip-packs, messenger-packs, and backpacks of all sizes and types. For example, frame assemblies according to various embodiments of the present disclosure may be incorporated into specialty packs, such as hydration packs that are designed to primarily or even solely contain a hydration system.

INDUSTRIAL APPLICABILITY

The frames and the backpacks and hydration systems disclosed herein are applicable to any field, including recreation, industrial and sporting, where back-mounted packs, including packs with hydration systems, are used.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A pack system, comprising:

a pack adapted to be secured upon a user's back, wherein the pack includes at least one compartment adapted to receive an object to be carried and a back-facing surface that is adapted to face a user's back when the pack is secured upon the user's back;

a harness adapted to secure the pack upon a user's back;

a frame assembly adapted to at least partially define the shape of the back-facing surface, wherein the frame assembly includes a body and a plurality of projecting members that extend from the body, and further wherein the plurality of projecting members includes a pair of upwardly extending frame arms and a single downwardly extending frame leg; and means for coupling the frame assembly and the pack together such that the frame assembly is flexed to have a complex curvature, wherein the means for coupling is adapted to couple the projecting members to the pack.

2. The system of claim 1, further comprising a hydration system with a fluid reservoir that is adapted to be received within the compartment, an elongate drink tube that extends from the reservoir out of the compartment to a mouthpiece from which a user may selectively draw drink fluid from the reservoir.

3. The system of claim 1, wherein the means for coupling includes a retainer assembly adapted to couple the frame assembly to the pack, wherein the retainer assembly defines a frame-receiving socket that is smaller in at least one dimension than a corresponding dimension of the frame assembly.

4. The system of claim 3, further comprising a hydration system with a fluid reservoir that is adapted to be received within the compartment, and an elongate drink tube that extends from the reservoir out of the compartment to a mouthpiece from which a user may selectively draw drink fluid from the reservoir.

5. The system of claim 1, wherein the means for coupling includes an external retention structure that is coupled to the pack and adapted to receive the frame assembly and to flex the frame assembly into a complex curvature.

6. The system of claim 5, wherein the complex curvature includes a convex curvature that corresponds to the user's lumbar region and a concave curvature that corresponds to the user's shoulder region.

7. The system of claim 1, wherein the means for coupling includes a pair of arm sleeves complementarily configured to receive the frame arms, and a leg sleeve complementarily configured to receive the frame leg.

8. The system of claim 7, further comprising a hydration system with a fluid reservoir that is adapted to be received within the compartment, and an elongate drink tube that extends from the reservoir out of the compartment to a mouthpiece from which a user may selectively draw drink fluid from the reservoir.

9. The system of claim 1, wherein the frame assembly includes means for selectively shaping the frame.

10. The system of claim 9, further comprising a hydration system with a fluid reservoir that is adapted to be received within the compartment, and an elongate drink tube that extends from the reservoir out of the compartment to a mouthpiece from which a user may selectively draw drink fluid from the reservoir.

11. A backpack, comprising:

a pack including a primary storage compartment with a back-facing surface;

a harness connected to the back-facing surface and configured to secure the pack on a user's body;

a retention structure connected to the back-facing surface, wherein the retention structure includes a pair of arm-receiving sleeves laterally separated from one another by a first width, and a leg receiving sleeve vertically separated from each of the arm receiving sleeves by a first length; and a frame assembly configured to at least partially define the shape of the pack, wherein the frame assembly includes a pair of generally upwardly-extending projecting members that are laterally separated from one another by a second width that is greater than the first width, and a downwardly extending projecting member that is vertically separated from the upwardly projecting members by a second length that is greater than the first length, and further wherein the retention structure is adapted to flex the frame laterally to approximately the first width and vertically to approximately the first length upon insertion of the projecting members into the sleeves.

12. The backpack of claim 11, wherein the retention structure is adapted to fixedly secure the projecting members to the pack.

13. The backpack of claim 11, wherein the retention structure includes a first region that is fixedly secured to the back-facing surface, and at least one free region that extends from the first region and which includes a releasable fastening mechanism.

14. The backpack of claim 11, further comprising a hydration system with a fluid reservoir that is adapted to be received within the compartment, and an elongate drink tube that extends from the reservoir out of the compartment to a mouthpiece from which a user may selectively draw drink-puid from the reservoir.

15. The backpack of claim 11, wherein the frame assembly is configured for removable insertion into the retention structure.

16. The backpack of claim 15, further comprising a hydration system with a fluid reservoir that is adapted to be received within the compartment, and an elongate drink tube that extends from the reservoir out of the compartment to a mouthpiece from which a user may selectively draw drink fluid from the reservoir.

17. The backpack of claim 11, wherein the retention structure is connected to the back-facing surface by an intermediate structure.

18. The backpack of claim 17, wherein the intermediate structure includes a harness.

19. The backpack of claim 11, wherein at least one of the sleeves includes a pad adapted to extend generally away from the back-facing surface and thereby toward a user's back when the backpack is worn on a user's back.

20. The backpack of claim 19, wherein the leg-receiving sleeve includes a pad adapted to cushion the downwardly extending projecting member against a user's lumbar region.

* * * * *

UNITED STATES PATENT AND TRADEMARK OFFICE

CERTIFICATE OF CORRECTION

PATENT NO. : 6,892,915 B2
DATED : May 17, 2005
INVENTOR(S) : Vincent C. Mares

It is certified that error appears in the above-identified patent and that said Letters Patent is hereby corrected as shown below:

Column 16,
Lines 19-20, after "a user may selectively draw" please delete "drink-puid" and insert -- drink fluid -- therefor.

Signed and Sealed this

Nineteenth Day of July, 2005

JON W. DUDAS
*Director of the United States Patent and Trademark Office*